United States Patent [19]

Renzi

[11] Patent Number: 4,805,948

[45] Date of Patent: Feb. 21, 1989

[54] DOOR SECURITY WEDGE DEVICE

[76] Inventor: David A. Renzi, 160 Dare Ave., Bridgeton, N.J. 08302

[21] Appl. No.: 158,856

[22] Filed: Feb. 22, 1988

[51] Int. Cl.[4] ..... E05C 17/54

[52] U.S. Cl. ..... 292/342

[58] Field of Search ..... 292/342, 343, 268, DIG. 15

[56] References Cited

U.S. PATENT DOCUMENTS

| | | | |
|---|---|---|---|
| D. 134,108 | 10/1942 | Adler . | |
| 1,582,751 | 4/1926 | Housteau | 292/342 |
| 2,492,032 | 12/1949 | Bloomfield | 292/342 |
| 2,703,728 | 3/1955 | Raber | 292/288 |
| 2,737,408 | 3/1956 | Sperry | 292/342 |
| 2,760,805 | 8/1956 | Stevens et al. | 292/268 X |
| 2,798,755 | 7/1957 | Zapotocny | 292/342 |
| 2,898,140 | 8/1959 | Gislason | 292/342 |
| 3,706,112 | 12/1972 | Newell | 292/343 X |
| 4,017,939 | 4/1977 | Schofield | 292/343 X |
| 4,660,323 | 4/1987 | Kanies | 49/70 |

FOREIGN PATENT DOCUMENTS

| | | | |
|---|---|---|---|
| 1036482 | 8/1958 | Fed. Rep. of Germany | 292/243 |

*Primary Examiner*—Richard E. Moore

*Attorney, Agent, or Firm*—Thomas A. Lennox

[57] ABSTRACT

A wedge security device to be positioned on a floor at the inside bottom edge of an inwardly opening door includes a wedge shape member including an upper and lower surface leading at a front acute angle such that the bottom edge of the door will ride up on the upper surface of the wedge with a rounded surface extension allowing the wedge to rock backwardly when the edge of the door engages the wedge, a resilient compressible pad to facilitate wedging of the member under the door and a rubber appendages pad on the bottom of the wedge shape to prevent sliding along the floor surface with a pair of guide member with slots to allow the door to move toward and up on the wedge shape, but prevent its movement backwardly away from engagement once it has been wedged into position.

17 Claims, 4 Drawing Sheets

DOOR SECURITY WEDGE DEVICE

BACKGROUND OF THE INVENTION

This invention involves a security device to be used by a person inside a room with a door opening inwardly to prevent unauthorized entry, and more specifically a wedge device which is placed on the floor inside the room abutting the bottom inner edge of the door.

A number of devices have been described for use with a door that opens inwardly in order to prevent unauthorized entry. These devices includes bars that interfit under the door knob and are wedged in position to prevent movement of the door as well as door stops that may be raised out of the floor to prevent movement of the door inwardly and thus prevent entry. A number of wedges are described which are used to hold the door in position after the door is opened in order to facilitate air flow or merely to keep the door out of the way and held in a certain chosen position. The use of a simple wedge under the door as a security device is typically not effective. Once the partially opened door has engaged the wedge, in the process moving it at least some distance away from the door jam, the door may then be backed away from the wedge. The door may then be violently pushed against the wedge by the intruder; closing it and then opening it against the wedge again and again. On each occasion the wedge is forced a little further away from the door until the intruder can reach around through the partially opened door and disengage the wedge.

None of the prior art devices satisfy this need nor attain the objects listed hereinbelow.

SUMMARY OF THE INVENTION

It is an object of the present invention to provide a security device that safely and effectively prevents unauthorized entry into a room with a door opening inwardly where a person is in the room and able engage the device.

It is a particular object of the present invention to provide a security device for a room with a door opening inwardly which will not damage either the door or the floor during use.

It is a particular object of the present invention to provide a wedge shaped security device that essentially cannot be moved away from the door by continuing to jam against it upon partially opening the door.

It is an additional object of the present invention to provide a security device that is effective on uncovered floors, such as vinyl sheet, vinyl tile, wood flooring or carpeting, without damaging any of the surfaces.

The wedge device of the present invention is constructed in a certain shape and of material limitations such that it will easily wedge under an opening door such that an intruder is only able to open the door an inch or so before the door is firmly wedged in position. Because of the nature of the wedge device, the intruder by disengaging the door and pulling it shut again before forcibly ramming the door again against the wedge shape will hardly ever be able to move the wedge sufficiently to open the door. Thus, the wedge shape may be taken by the person wanting safety on trips to be used in hotel rooms or let rooms for security purposes. For the utmost security protection, the wedge shape device is preferably attached to the door using the guide means described herein below. The guide means is constructed such that when the intruder partially opens the door and engages the wedge device, the guide means allows that movement without resistance. However, once the door has been moved against the wedge shape, the guide means prevents that distance from being significantly increased by further movement of the door. Thus, the guide means engages when the door is pulled backwards toward closure by the intruder with the intent of forcing the door against the wedge a second or third time, with hopefully greater and greater distance between the door and the wedge, thus increasing the power applied to the wedge. However, the guide means engages and maintains the distance once the door has been moved toward the wedge shape so that the wedge shape is pulled on backwardly toward the door when the intruder attempts partial closure of the door and readies for another assault. In this fashion, the wedge shape is pulled with the door and maintains the wedge with the door in its position at or close to closure. If the door is opened slowly so that the edge of the door barely engages the wedge, closure of the door also tends to rock the wedge upwardly and either move the wedge with the door or further wedge it tightly against the bottom edge of the door, thereby essentially preventing further door movement. If the door is pushed hard the first time, the door wedges tightly and the guide means essentially prevents disengagement from the wedged position. Thus, the intruder can never gain purchase power by separating the distance between the door and the wedge shape device. In fact, the intruder's actions actually wedges the shape closer to the door and makes entry essentially impossible.

The invention is a security device to be positioned on a floor at an inside bottom edge of a door opening inwardly to prevent unauthorized entry through the door. The device includes a wedge shaped member including an upper surface and a lower surface meeting at a front acute angle forming a pointed edge positionable proximate the inside bottom edge of the door. The acute angle between the upper and lower surfaces is sufficient to allow the bottom edge of the door to ride up on the upper surface as the door is opened inwardly. The wedge shaped member preferably further includes a rounded surface extension of the lower surface curving upwardly from the plane of the lower surface and away from the front edge to a rear portion of the wedge member, the shape of the curve being sufficient to allow the rear portion of the wedge member to rock downwardly toward the floor as the bottom edge of the door rides up the upper surface. The wedge shaped member further preferably includes a resilient compressible pad member attached to the rounded surface, and a dragging surface means attached to the lower surface and a lower surface of the pad member to resist sliding movement of the surface means in pressure contact with the floor. The security device further preferably includes a guide means attached between the wedge member, more preferably to a rear portion of the wedge member, and the door to fix and hold a minimum distance attained between the door and the wedge member when the door is pulled back toward the closure after engaging the wedge member. A more preferred embodiment is the guide means including a guide member pivotally connected to a first end to the rear portion of the wedge shape and at the second end to an inside surface of the door, the length of the guide member being sufficient to angle upwardly from the floor. The pivotal connection to the door includes a horizontal pin member rigidly attached to the door and an open slot along the length of the guide member terminating at the second end and of a size and shape sufficient to allow the guide member to freely ride on the horizontal pin upwardly and toward the door as the door edge engages the wedge shape. The pivotal connection further includes a plurality of downwardly depending stops extending into the slot, the stops being shaped and angled to engage the horizontal pin as the guide member is attempted to be moved downwardly and away from the door.

DESCRIPTION OF PREFERRED EMBODIMENTS

Figure 1:
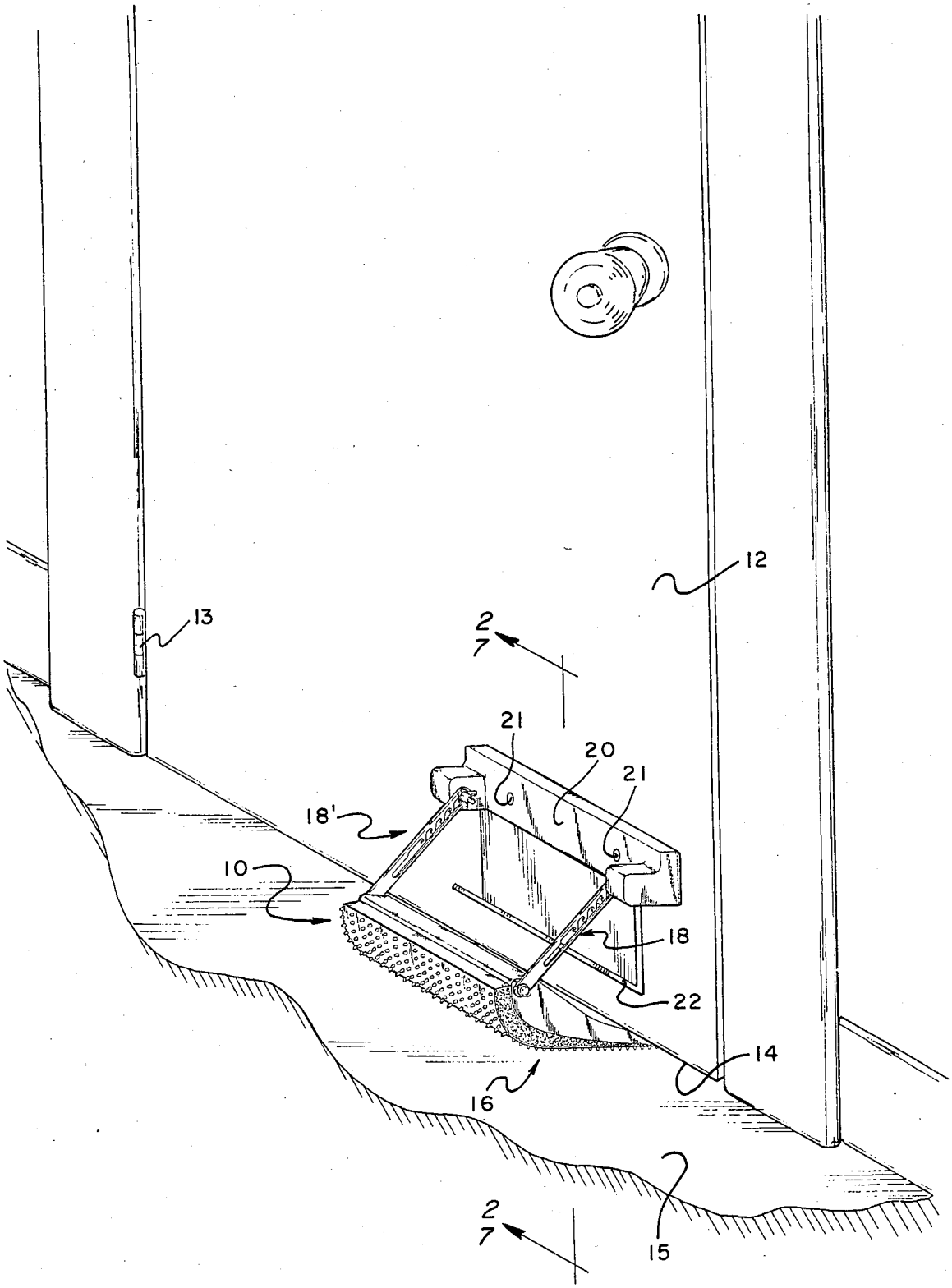
FIG. 1 is a perspective view of a security device of the present invention mounted on the inside door engaging the inside bottom edge of the door.
Figure 2:
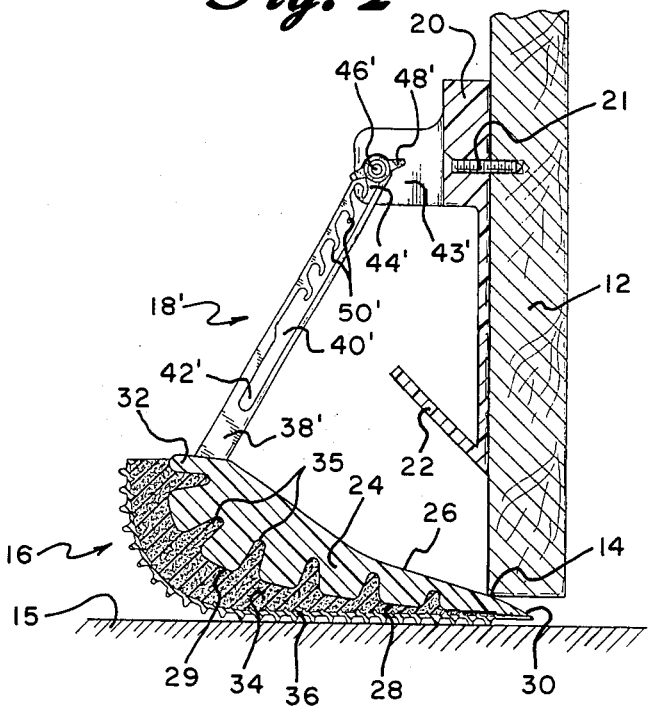
FIG. 2 is a cross-sectional view taken along lines 2—2 of FIG. 1.
Figure 3:
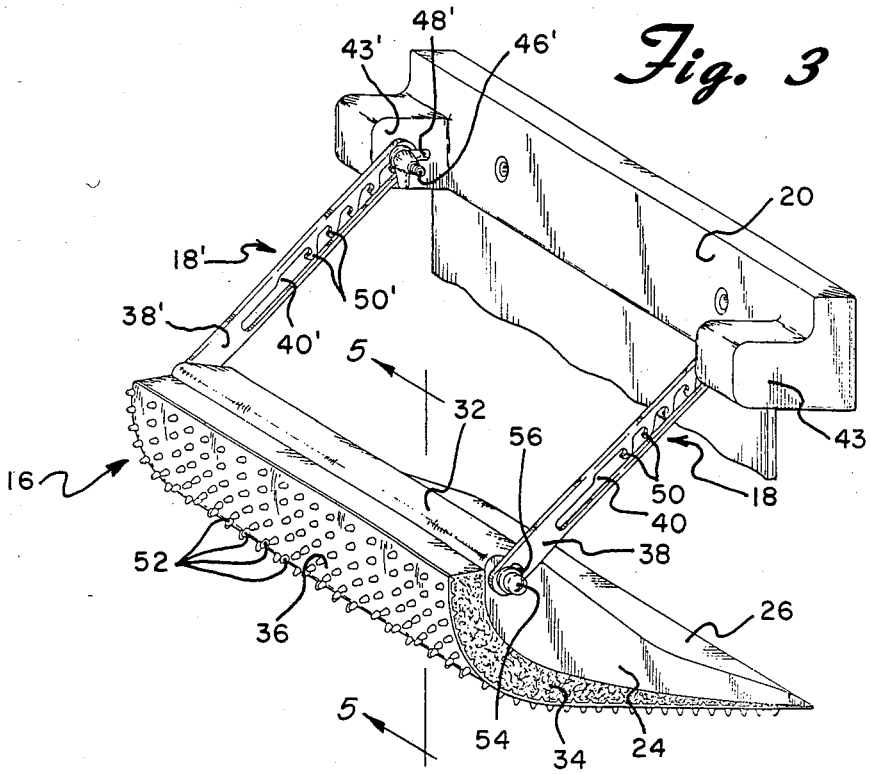
FIG. 3 is an expanded perspective view of the security device illustrated in FIG. 1.
Figure 4:
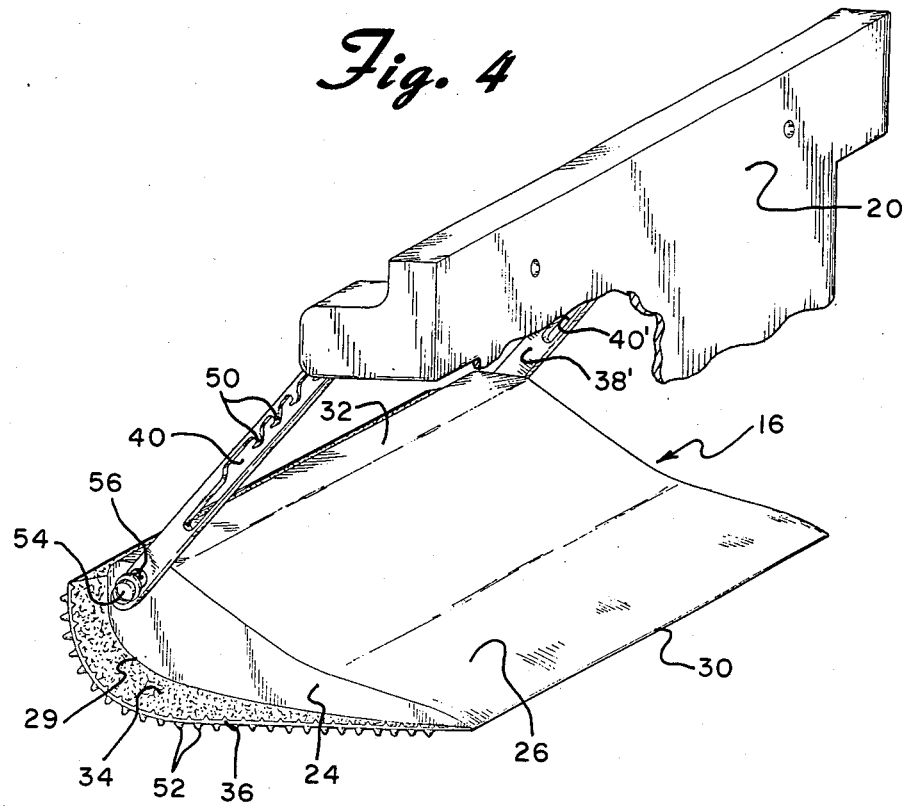
FIG. 4 is a partial cut away perspective view of the security device illustrated in FIG. 1.
Figure 5:
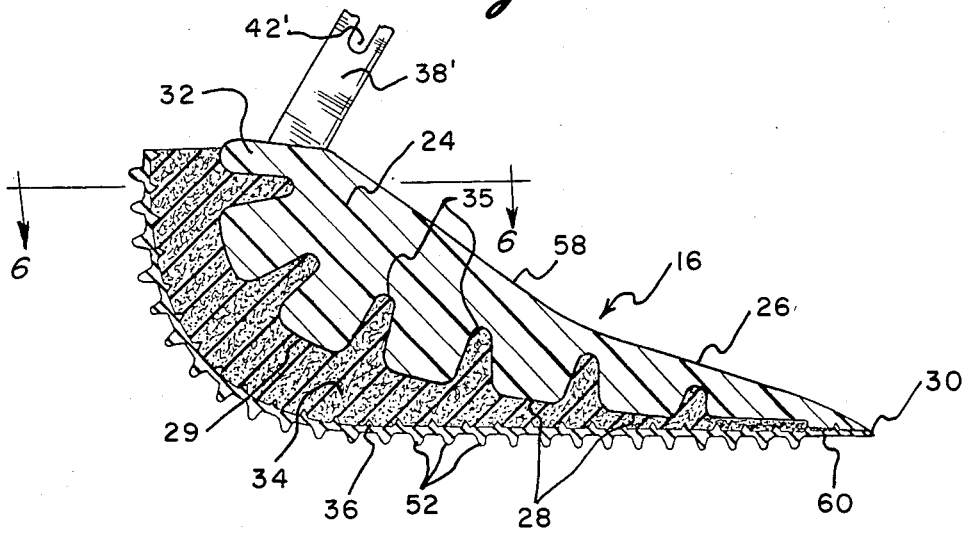
FIG. 5 is a vertical cross-sectional view taken along lines 5—5 of FIG. 3.
Figure 6:
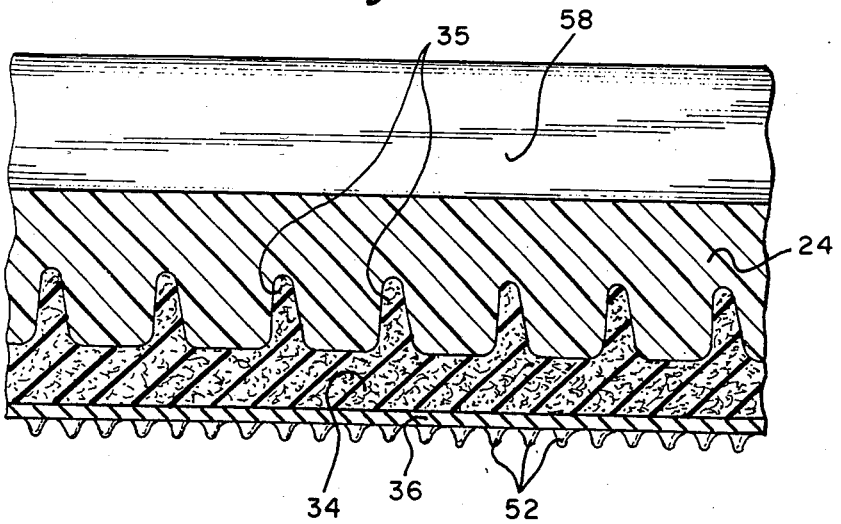
FIG. 6 is an expanded partial cross-sectional view taken along lines 6—6 of FIG. 5.
Figure 7:
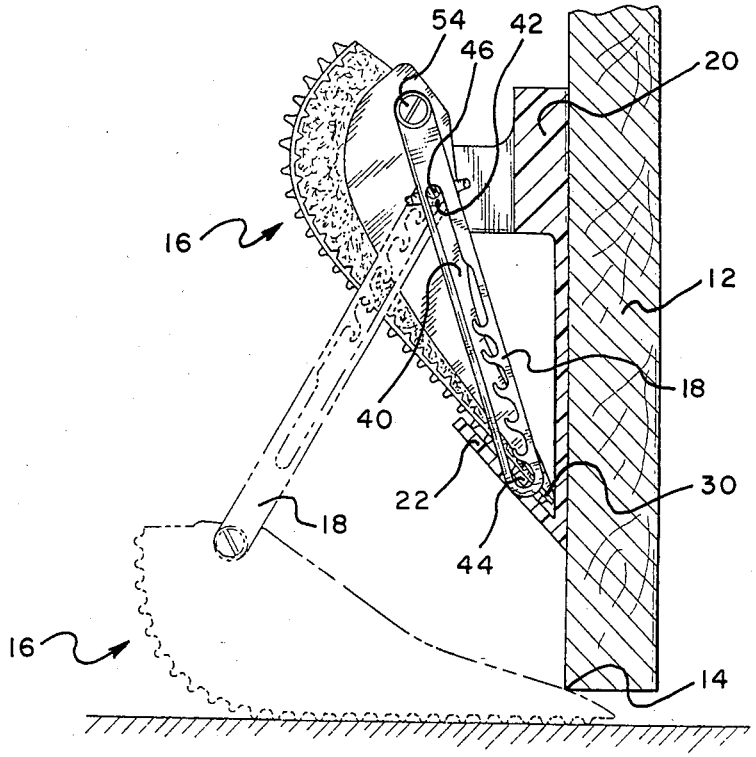
FIG. 7 is a side elevational view of the security device illustrated in FIG. 1 showing the device lifted and installed in the storage position.

In FIG. 1, security device 10 is shown in position attached on the inside of door 12 which opens inwardly on hinge 13. Wedge shaped device 16 is positioned proximate bottom inside edge 14 of door 12. Wedge 16 is attached through guide device 18 and 18' to attachment bracket 20 which is attached through screws 21 to the inside of door 12 near bottom edge 14. In FIG. 2, storage bracket 22 is shown as an extension of attachment bracket 20 attached against door 12. Wedge 16 includes rigid wedge shape 24 which has upper surface 26 and lower surface 28. Rounded surface extension 29 is an extension of lower surface 28 curving upwardly from the plane of lower surface 28 and away from leading front edge 30 of rigid wedge shape 24 and toward a rear portion 32 of wedge shape 24. Foam rubber section 34 covers most of lower surface 28 and extends into depressions and crevices 35 into wedge 24 to provide reduced weight and additional attachment surface without sacrificing significant compressive strength. Skid proof rubber surface panel 36 is adhesively attached to the bottom surface of foam 34 and extends all the way to leading edge 30. Foam 34 does not extend all the way to leading edge 30 and terminates about one inch from that leading edge. Metal guide member 38' is attached at its lower end proximate rear end 32 of wedge 24 and at its upper end to support member 43' extending outwardly horizontally from attachment bracket 20. Slot 40' extends along most of the length of bracket 38' terminating at its lower end at opening position 42' and terminating at the upper end of bracket 38' at opening position 44'. Bracket 38' is attached at its upper end through opening 44' which hangs on horizontal pin 46' which is threaded to receive wing nut 48' which holds bracket 38' in position but allows it to rotate freely. In operation, guide member 38' rides upwardly on pin 46' which is free at all times to move downwardly along slot 40'. A plurality of stop appendages 50' extend downwardly into slot 40' of a shape and distance to allow pin 46' to ride downwardly past the stops. Stops 50' are shaped such that they will engage pin 46' and prevent movement upwardly of pin 46' past any engaged stop appendage 50'. In FIG. 3, wedge shape device is held in position by guide device 18 and 18'. Guide member 38 is attached to wedge 24 at rear end 32' through longitudinal elongated hole 56 through which attachment screw 54 extends and engages the body of wedge 24. Bottom rubber surface 36 is equipped with a multiplicity of integral rubber appendages extending downwardly and covering the bottom surface. Appendages 52 are chosen of a shape and size to catch in and engage into carpeting covering floor 15. If floor 15 is vinyl tile, asphalt tile, wood flooring or the like, the rubber-like composition of sheet member 36 is chosen to provide high frictional resistance with the floor, particularly when wedge device 16 is forced downwardly hard against the floor surface. Foam 34 and bottom surface 36 may be an integral material wherein the material is compressible and has high friction resistance against the floor but has sufficient strength in the appendages to prevent sliding and disengagement from the carpet surface. Appendages 52 may be in a variety of shapes including conical shapes as illustrated in FIG. 3 or they may be molded in the shape of tiny suction cups which will not only engage into the carpet surface but will also tend to grip the floor surface when used in a room without carpeting. Screws 54 and 54', which may be replaced by wing bolts, allow easy removal of wedge security device 16 so that it can be carried and used while traveling in motel rooms, hotel rooms or the like. The shape, construction and composition of wedge security device 16 allows it to be placed inside a door and be a most effective deterrent should someone attempt to enter the room while the owner is inside. Wedge member 24 is molded of semi-rigid plastic such as polyethylene, polypropylene, acrylonitrile butadiene styrene copolymer, nylon, acetal polymers and like polymeric plastics. Olefin polymers are preferred to provide upper surface 26 with a slidable surface to allow edge 14 of the door to easily ride up on that surface compressing the security device and wedging the door in position. In FIG. 4, wedge security device 16 is attached by attachment screw 54 which extends through elongated hole 56 allowing some play in that attachment. This play, allows wedge member 24 to rock downwardly on curved surface 29 as door edge 14 rides up on surface 36. In FIG. 5, wedge shaped security device 16 is shown in cross-section enlarged to illustrated that the acute angle between upper surface 26 and lower surface 28 is in the range of about 5 to 20 degrees and more preferably about 10 to 15 degrees terminating in front edge 30. Front edge 30 is beveled off slightly as to prevent the wedge shape from being too thin at the front and being fragile. Foam 34 extends under and is attached to rounded surface 29 and lower surface 28, but terminates as it approaches leading edge 30 providing only thin rubber surface 60 to ensure that the leading edge will be under inside door edge 14 and that edge will easily and assuredly ride up on surface 26. Deep depressions 35 extend into the body of rigid plastic wedge 24 and may extend almost to upper surface 26 to reduce weight and the amount of plastic necessary to construct the wedge. It is only necessary that plastic wedge shape 24 have sufficient plastic extending downwardly to surfaces 28 and 29 to support the compression forces from the door on the wedge shape. The angle of upper surface 26 with lower surface 28 continues a substantial distance from leading edge 30 and then upper surface 26 is angled further upwardly at angled surface 58, that angle being about 30 degrees from lower surface 28. This increased angle is chosen to be sufficient to insure that the lower inside edge 14 of the door cannot ride over wedge security device 16. Thus, with this angle and even with foam 34 completely compressed, the vertical thickness of wedge security device 16 is greater than one inch and in practice is at least about an inch and a half in thick. In FIG. 6, the horizontal cross-sectional view illustrates that there is a multiplicity of depressions into wedge member 24 to allow rubber foam 34 to extend well into the wedge shape to reduce weight and increase surface contact area between the two materials. In FIG. 7, wedge shape security device 16 is shown raised and engaged into storage hook 22 for storage purposes. Pin 46 has ridden along the entire length fo slot 40 from position 44 to lower position 42 of bracket 18. Since bracket 18 can pivot on screw 54, leading edge 30 of wedge security device 16 is lifted and is engaged over hook 22 to hold the device up and out of the way when not in use.

While this invention has been described with reference to the specific embodiments disclosed herein, it is not confined to the details set forth and the patent is intended to include modifications and changes which may come within and extend from the following claims.

I claim:

1. A security device to be positioned on a floor at an inside bottom edge of a door with an inside surface, the door opening inwardly in the direction the inside surface is facing, the device being to prevent unauthorized entry through the door, the device comprising:

(a) a wedge shaped member comprising:

(i) an upper surface and a lower surface meeting at a front acute angle forming a pointed edge positionable proximate the inside bottom edge of the door, wherein the acute angle between the upper and lower surfaces is sufficient to allow the bottom edge of the door to ride up on the upper surface toward a rear portion of the wedge shaped member as the door is open inwardly, and (ii) a dragging surface means attached to the lower surface to resist sliding movement of the dragging surface means in pressure contact with the floor, and (b) guide means attached between the wedge member and the door to fix and hold a minimum distance attained between the door and the wedge member when the door is pulled toward closure after engaging the wedge member, the guide comprising a guide member having a first and second end, a pivotal connection of the first end to the rear portion of the wedge shape, and a pivotal connection of the second end to the inside surface of the door, the length of the guide member being sufficient to angle upwardly from the floor, the pivotal connection to the door comprising:

(a) a horizontal pin member rigidly attached to the inside surface of the door, (b) an open slot along the length of the guide member terminating at the second end and of a size and shape sufficient to allow the guide member to freely ride on the horizontal pin upwardly and toward the door as the door edge engages the wedge shape, and (c) a plurality of downwardly depending stops extending into the slot, the stops being shaped and angled to engage the horizontal pin as the guide member is moved downwardly and away from the door.

2. The security device of claim 1 wherein the wedge shaped member further comprises a rounded surface extension of the lower surface curving upwardly from the plane of the lower surface and away from the front edge to a rear portion of the wedge member, the shape of the curve being sufficient to allow the rear portion of the wedge member to rock downwardly toward the floor as the bottom edge of the door rides up the upper surface, and the security device further comprises a resilient compressible pad member attached to the rounded surface.

3. The security device of claim 1 wherein said acute angle is in the range of about five degrees to about twenty degrees.

4. The security device of claim 1 wherein said acute angle is about ten to fifteen degrees.

5. The security device of claim 1 wherein the dragging surface means comprises a surface having a multiplicity of rubberlike appendages extending downwardly from said surface.

6. The security device of claim 2 wherein the rounded surface extension has radius of curvature of about four to about ten inches.

7. The security device of claim 2 wherein the resilient compressible pad is foam rubber.

8. A security device to be positioned on a floor at an inside bottom edge of a door opening inwardly to prevent unauthorized entry through the door, the device comprising:

(a) a wedge shaped member comprising:

(i) an upper surface and a lower surface meeting at a front acute angle forming a pointed edge positionable proximate the inside bottom edge of the door, wherein the acute angle between upper and lower surfaces is sufficient to allow the bottom edge of the door to ride up on the upper surface as the door is opened inwardly, and (ii) a rounded surface extension of the lower surface curving upwardly from the plane of the lower surface and away from the front edge to a rear portion of the wedge member, the shape of the curve being sufficient to allow the rear portion of the wedge member to rock downwardly toward the floor as the bottom edge of the door rides up the upper.surface, (b) a resilient compressible pad member attached to the rounded surface, and (c) a dragging surface means attached to the lower surface of the pad member to resist sliding movement of the surface means in pressure contact with the floor.

9. The security device of claim 8 wherein the security device further comprises a guide means attached between the rear portion of the wedge member and the door to fix and hold a minimum distance attained between the door and the rear portion of the wedge member when the door is pulled toward closure after engaging the wedge member.

10. The security device of claim 9 wherein the guide means comprises a guide member having first and second ends, pivotally connected at the first end to the rear portion of the wedge shape and at the second end to an inside surface of the door, the length of the guide member being sufficient to angle upwardly from the floor, the pivotal connection to the door comprising:

(a) a horizontal pin member rigidly attached to the door, (b) an open slot along the length of the guide member terminating at the second end and of a size and shape sufficient to allow the guide member to freely ride on the horizontal pin upwardly and toward the door as the door edge engages the wedge shape, and (c) a plurality of downwardly depending stops extending into the slot, the stops being shaped and angled to engage the horizontal pin as the guide member is moved downwardly and away from the door.

11. The security device of claim 8 wherein acute angle is in the range of about five degrees to about twenty degrees.

12. The security device of claim 8 wherein acute angle is about ten to fifteen degrees.

13. The security device of claim 8 wherein the dragging surface means comprises a surface having a multiplicity of rubberlike appendages extending downwardly from said surface.

14. The security device of claim 8 wherein the rounded surface extension has radius of curvature of about four to about ten inches.

15. The security device of claim 8 wherein the resilient compressible pad is foam rubber.

16. A security device to be positioned on a floor at an inside bottom edge of a door with an inside surface, the door opening inwardly in the direction the inside surface is facing, the device being to prevent unauthorized entry through the door, the device comprising:

(a) a wedge shaped member comprising:

(i) an upper surface and a lower surface meeting at a front acute angle forming a pointed edge positionable proximate the inside bottom edge of the door.

wherein the acute angle between the upper and lower surfaces is sufficient to allow the bottom edge of the door to ride up on the upper surface as the door is opened inwardly.

(ii) a rounded surface extension of the lower surface curving upwardly from the plane of the lower surface and away from the front edge to a rear portion of the wedge member, the shape of the curve being sufficient to allow the rear portion of the wedge member to rock downwardly toward the floor as the bottom edge of the door rides up the upper surface, and (iii) a resilient compressible pad member attached to the rounded surface, and (iv) a dragging surface means attached to the lower surface of the pad member to resist sliding movement of the surface means in pressure contact with the floor, (b) guide means attached between the rear portion of the wedge member and the inside surface of the door to fix and hold a minimum distance attained between the inside surface of the door and the rear portion of the wedge member when the door is pulled toward closure after engaging the wedge member.

17. The security device of claim 16 wherein the guide means comprises a guide member having first and second ends, a pivotal connection of the first end to the rear portion of the wedge shape and a pivotal connection of the second end to the inside surface of the door, the length of the guide member being sufficient to angle upwardly from the floor, the pivotal connection to the door comprising:

(a) a horizontal pin member rigidly attached to the inside surface of the door, (b) an open slot along the length of the guide member terminating at the second end and of a size and shape sufficient to allow the guide member to freely ride on the horizontal pin upwardly and toward the door as the door edge engages the wedge shape, and (c) a plurality of downwardly depending stops extending into the slot, the stops being shaped and angled to engage the horizontal pin as the guide member is moved downwardly and away from the door.

* * * * *